United States Patent [19]

Maurer

[11] Patent Number: 5,024,587

[45] Date of Patent: Jun. 18, 1991

[54] VALVELESS PUMP

[75] Inventor: Christoph Maurer, Ringstrasse, Fed. Rep. of Germany

[73] Assignee: Drägerwerk Aktiengesellschaft, Lübeck, Fed. Rep. of Germany

[21] Appl. No.: 456,951

[22] Filed: Dec. 26, 1989

[30] Foreign Application Priority Data

Jan. 12, 1989 [DE] Fed. Rep. of Germany ..... 3900697

[51] Int. Cl.[5] ..... F04B 19/22

[52] U.S. Cl. ..... 417/488; 417/498; 222/54; 222/333

[58] Field of Search ..... 417/498, 488, 322; 222/54, 333

[56] References Cited

U.S. PATENT DOCUMENTS

| | | | |
|---|---|---|---|
| 1,844,772 | 2/1932 | La Pointe | 417/488 |
| 3,302,578 | 2/1967 | Anderson | 417/539 |
| 4,405,294 | 9/1983 | Albarda | 417/488 |
| 4,726,741 | 2/1988 | Cusack | 417/322 |

*Primary Examiner*—Leonard E. Smith

*Assistant Examiner*—M. Kocharov

*Attorney, Agent, or Firm*—McGlew & Tuttle

[57] ABSTRACT

The present invention pertains to a pump, in which two pistons moving in the same direction in a common cylinder bore are provided to generate the suction intake and pressure, discharge effects as well as for control. Both pistons are held by fastening members to perform a lifting movement, and one of the pistons is a control piston for performing a constant lifting movement, while the other piston is a pump piston for performing a variable lifting movement. The difference in the lifts, multiplied by the cross section of the cylinder bore, determines the delivery volume of the pump. A braking force to the oscillating piston eliminated and the velocity of discharge of the medium to be delivered is increased by providing a member 8, whose longitudinal extension between fastening members of the two pump pistons is variable during one pump cycle so as to generate the difference between the heights of lift of the two pistons that are rigidly connected to said fastening members.

10 Claims, 2 Drawing Sheets

VALVELESS PUMP

BACKGROUND OF THE INVENTION

Field of the Invention

The present invention relates as general to pumps and particularly pertains to a new and useful valveless pump for delivering liquid or gaseous media.

A valveless pump described in U.S. Pat. No. 4,405,294 dated Sept. 20, 1983, has two pistons which are guided jointly in the bore of a cylinder. The two pistons are moved in the same direction, such that one of the pistons regularly performs the full lifting or pumping movement, while the other piston performs only part of the lift. The difference in lifts forms, together with the cross section of the cylinder bore, the delivery volume of the pump.

One of the pistons is attached without axial clearance to a slide, which surrounds the cylinder in the shape of a U, while the other piston is not attached to the slide, as a result of which an axial lift relative to the slide is possible. This piston acts as a pump piston.

When the slide is moved to and from in its longitudinal direction by a drive, the pump piston lags behind the movement of the slide and consequently lags behind the movement of the control piston connected to it due to the friction effect of a braking spring that touches it on both sides. One end face of it lies in one of the directions of movement of the end face of the control piston, while a hollow space, which represents the delivery volume, is formed in the other direction of movement. The empty space or cavity is constantly forming and disappearing in the cylinder at the dead centers of the movement. The inlet and outlet pipes for the medium to be delivered are located at the cavity of the cylinder.

If the pump is to deliver at high back pressure, the braking spring must be very strong. However, this leads to great wear on the spring and the piston.

This disadvantage is avoided with the pump described in U.S. Pat. No. 3,302,578. Here, the braking force is consumed by an electromagnet. The latter is energized and de-energized by limit switches during the pump cycle, so that the braking force is present only during the ejection phase, during which the medium to be pumped is delivered through the outlet. Movement causing friction and consequently intense wear are thus avoided. However, a disadvantage of this pump is the fact that the large mass of the electromagnet must constantly be accelerated. This requires a large and heavy design and relatively high drive power for the pump.

Both pumps described above share the disadvantage of a low discharge velocity, which is predetermined by the maximum speed of rotation of the eccentric drive used.

SUMMARY OF THE INVENTION

The highest possible discharge velocity would be advantageous for metering liquids, because the tendency to droplet formation in the liquid being delivered would thus be avoided.

Accordingly it is an object of the present invention to provide a pump in which the lowest possible power loss occurs in generating a variable lifting movement, in which no mechanical wear occurs, and which can be manufactured with the least expensive equipment.

To achieve this task, a member whose longitudinal extension is variable in the course of one pump cycle is arranged between the fastening members in the pump to generate the difference in the heights of lift of the two pistons.

In another embodiment of the present invention, the member of variable length is to be designed as a piezotransducer. The length of the member is now influenced by an electrical voltage applied to the member.

It is also possible to make the member of variable length from a magnetorestrictive material and to bring about the change in length by the action of a magnetic field applied to said member.

Due to the thermal expansion of the components of the pump, its delivery is temperature-dependent. In another embodiment of the present invention, the change in the length of the member of variable length can be controlled via a compensating device such that the delivery of the pump is essentially independent of the temperature.

In another embodiment of the present invention, at least one of the pistons itself comprises a member of variable length, especially as a piezotransducer (including a piezoelectric element).

The advantage achieved with the present invention lies in the fact that it is no longer necessary to apply a braking force to the pump piston. The intense wear of a braking spring or the expensive design including an electromagnet including an electromagnet are thus eliminated.

Another advantage is the fact that the pump drive can continue to operate even when no delivery is desired. The delivery can be changed very rapidly and with low inertia by influencing only the drive of the member of variable length and consequently the difference between the lifts of the two pistons.

If two separate control units are used for the pump drive and for driving the member of variable length, the present invention also improves the reliability of avoiding increases in metering, which is very important, e.g., when the pump is used as a metering pump for anesthetics. If the pump drive rotates at an excessively high speed due to a defect, this does not yet lead to an increase in dosage, because the synchronization with the change in the length of the member of variable length is missing. Similarly, a defect in the drive of the member of variable length does not yet lead to an increase in dosage. Consequently, if two separate control devices are used, only two defects that occur simultaneously and synchronously will lead to an increase in the dosage delivered by the pump. The probability of such a double defect is very low.

The present invention also leads to an increase in the range of control of the pump. The delivery can be regulated by both the frequency of the pump drive and the difference between the lifts (stroke) of the two pistons.

If a member whose length changes very rapidly is used (e.g., a piezotransducer), the velocity of discharge at the pump outlet can be greatly increased according to the present invention. As was mentioned above, this is important for avoiding droplet formation during the delivery of small amounts of liquids.

The high velocity of discharge, in conjunction with a check valve at the pump outlet, also reduces the leakage of the pump. At a given cross section of the gap between the piston and the cylinder bore and a given back pressure against which the medium must be delivered, the leakage is determined by the time during which the back pressure is able to press the medium through the gap. At the possible high velocity of discharge guaranteed by the present invention, the check valve is open for a very short time only, so that the leakage is small. In addition, the check value is opened and closed very precisely due to the rapid buildup and decrease in pressure. Therefore, and because of the small amount of leakage, the pump operates more accurately and is less dependent on back pressure than conventional designs.

Accordingly it is an object of the invention to provide a method and apparatus to provide a dosing of a substance such as a narcotic to a respirator using a pump cylinder having spaced apart inlet and outlet ports arranged along its axis and having two pistons therein which are arranged in opposition so that their end faces may move toward and away from each other and which includes connecting the pistons so that they are moved axially toward and away from each other in a manner so as to bring the pistons together substantially at the inlet port and to effect the movement of one piston while the first is arranged adjacent the end port to bring in a dosage of material from the inlet port, to then move the pistons together toward the outlet port while they are in spaced relationship and to thereafter close the pistons toward each other at the outlet port to finish a pumping cycle and to do this by connecting the pistons together by a variable length member to effect movement of the pistons in the desired relationship.

A further object of the invention is to provide a pumping device which includes a cylinder having an axially spaced apart inlet and outlet ports and includes first and second pistons which are moveable in the cylinder from positions adjacent the inlet port to positions adjacent the outlet port and including a slide which is moveable backwardly and forwardly and connected through a fastening member to each associated piston and including a connection member between said slides which is of variable length.

A further object of the invention is to provide a pump which includes two moveable pistons in a single cylinder which are interconnected by a member whose length changes vary rapidly so that the velocity of the discharge at the pump outlet can be greatly increased.

A further object of the invention is to provide a pump for dosing materials which operates with a minimum of droplet formation during the delivery of small amounts of liquids.

A further object of the invention is to provide a pump which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENTS

Figure 1A:
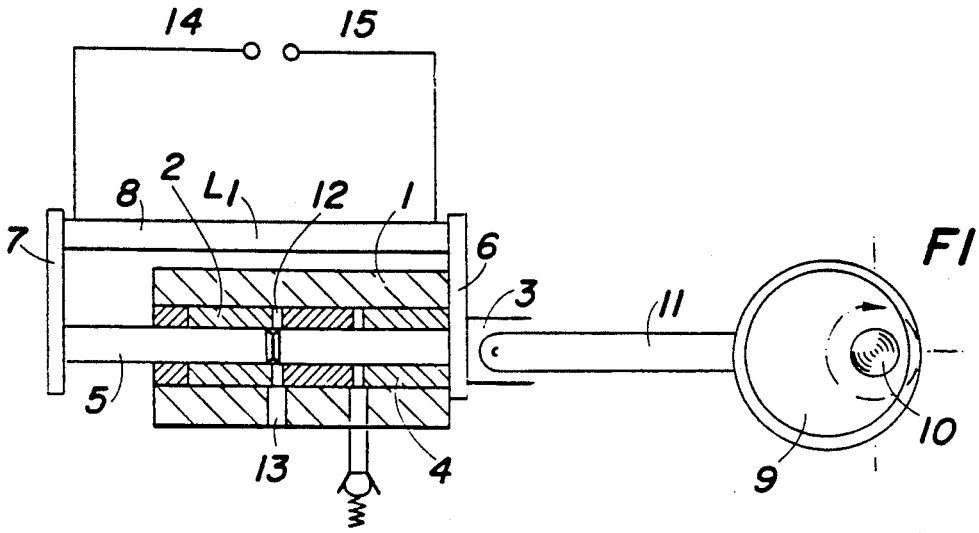
FIG. 1A is a schematic axial sectional view of a dosing pump constructed in accordance with the invention.

Referring to the drawings in particular, the inventive pump comprises a pump body 1 with a cylinder lining 2 and a rigidly mounted, driven slide 3. The slide 3 is connected to or includes a control piston 4 and a pump piston 5, both of which are rigidly connected via the fastening members 6 and 7 to a variable length member 8, which comprises a piezotransducer in this embodiment. A motor (not shown), which rotates the eccentric or cam plate 9 around its axis of rotation 10, is used to drive the pump. The rotation of the eccentric cam plate is transformed into an alternating translatory movement of the slide by a connecting rod 11.

FIG. 1A shows the slide 3 of the pump at its left dead center. The variable length member of piezotransducer 8 is in its shortest state $L_1$, and the two pistons 4 and 5 touch each other. The contact surface of the pistons is located in the plane of an annular gap 12 in the cylinder liner 2, which communicates with the inlet 13 of the pump.

Figure 1B:
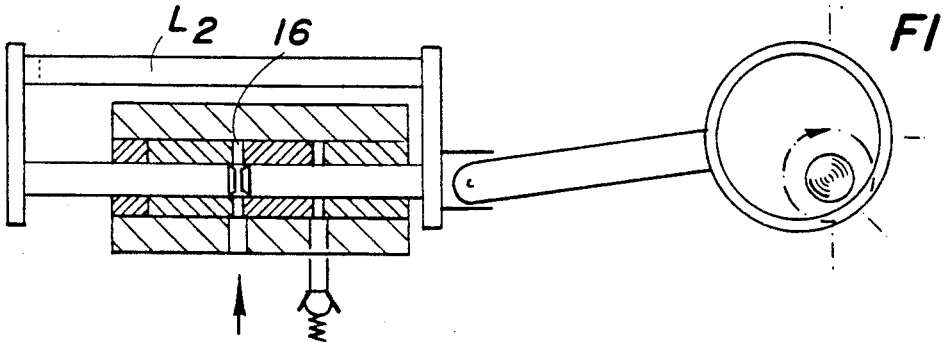
FIGS. 1B, C, and D, are views similar to FIG. 1A showing schematically four consecutive phases of the pumps cycle.

The piezotransducer is now brought relatively slowly into its longest state $L_2$ by increasing the control voltage, which is applied via the connection lines 14 and 15. The member which is a piezotransducer has reached this state during the phase shown in FIG. 1B, and the pump drive has meanwhile rotated further through a small angle. Due to the increase in the length of the piezotransducer, said pump piston 5 is pulled out of said cylinder liner by a certain amount, and a delivery space 16 opens between the two pistons 5 and 4. The medium to be delivered flows through the inlet 13 and into a delivery space 16 (FIG. 1B) due to the vacuum generated.

The drive rotates further and displaces the two pistons to the right while the length $L_2$ of said piezotransducer remains constant. The pump piston closes the annular gap 12, and the medium enclosed is also delivered to the right in the cylinder.

Figure 1C:
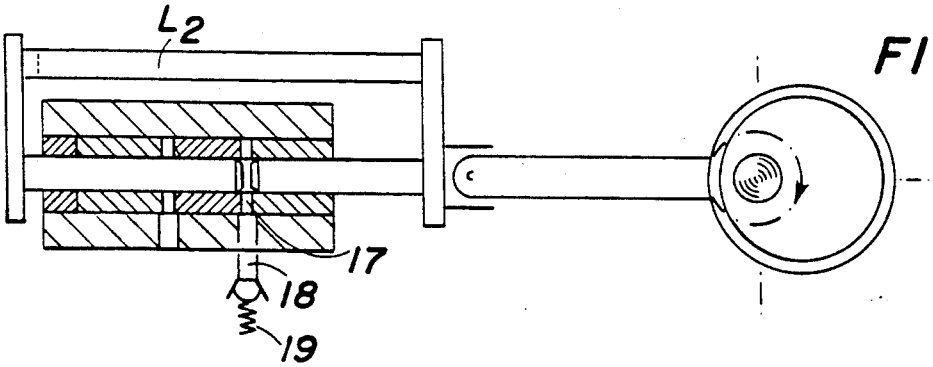

During the phase of the pump cycle shown in FIG. 1C, the slide 3 has reached its right dead center. The delivery space 16 with the medium enclosed in it is now located in the plane of a second annular gap 17 in the cylinder liner 2, which communicates with the outlet 18 of the pump.

Figure 1D:
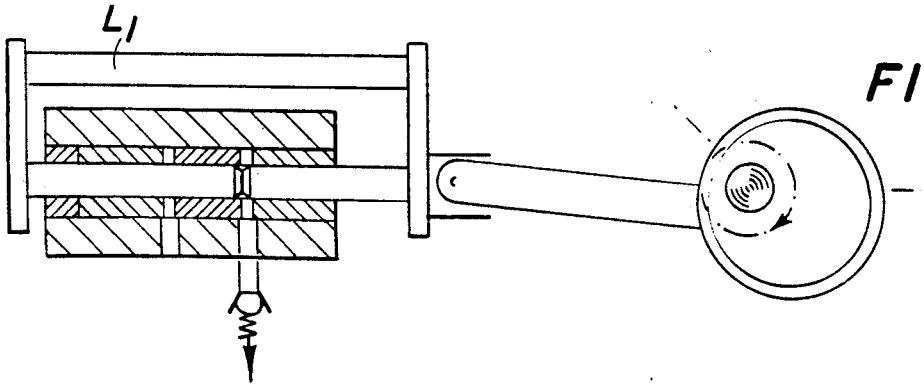

During the phase of the pump cycle shown in FIG. 1D, the control voltage of the piezotransducer 8 is rapidly reduced, so that its length is again reduced to the original value $L_1$. As a result, the two pistons are moved toward each other very rapidly (typically within 0.5 msec). The pressure in the delivery space 16 rises, the check valve 19 opens, and the medium is discharged through said outlet 18.

The drive continues to rotate and pushes the pistons, which are in contact with one another, to the left until the position shown in FIG. 1A is reached. The pump cycle is thus completed.

Figure 2:
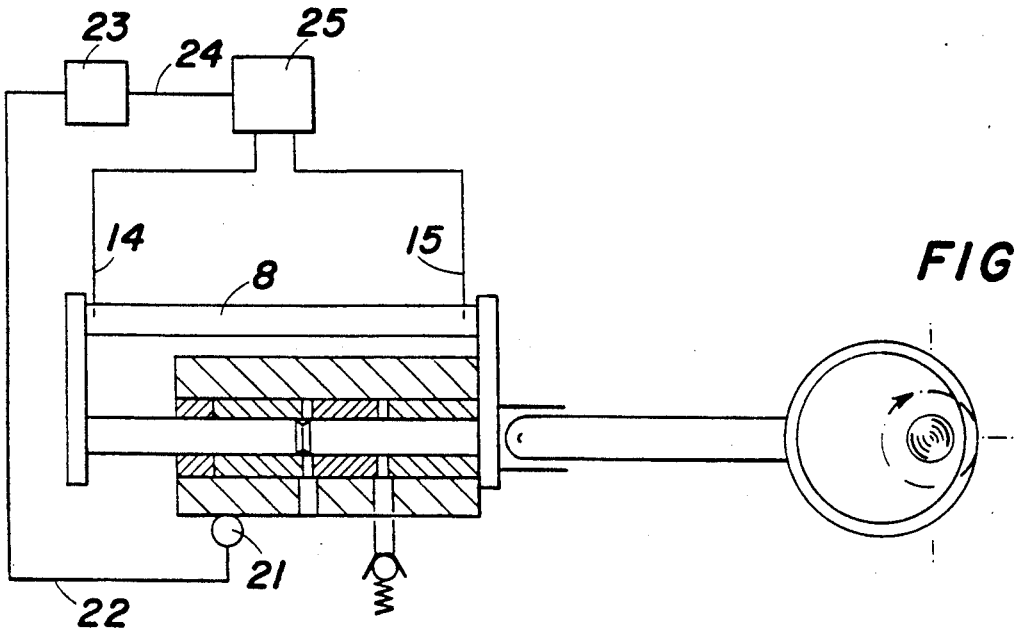
FIG. 2 is a view similar to FIG. 1A of another embodiment of the invention.

FIG. 2 shows a temperature-compensating device with the pump, which is used to prevent temperature-induced variations in delivery.

The temperature of the pump body or its immediate vicinity is measured with a temperature sensor 21. The measured signal enters a compensating circuit 23 via a signal line 22. The compensating circuit controls the power supply unit 25 of the piezotransducer 8 corresponding to a predetermined characteristic such that a heat-induced change in pump delivery is compensated by intentionally changing the difference between the lifts of the pistons. This is made possible, for example, by varying the maximum output voltage of the power supply unit 25 and consequently the maximum length of the piezotransducer corresponding to the temperature measured.

What is claimed is:

1. A valveless pump comprising a cylinder having spaced apart inlet and outlet ports, first and second opposed axially aligned pistons moveable in said cylinder, a fastening member connected to each of said first and second pistons, a moveable slide connected to both said fastening members, and variable length means connected to at least one of said fastening members so as to be carried by one of said fastening members for adjusting the distance between said first piston and said second piston at selected times.

2. A valveless pump according to claim 1 wherein said variable length means is a piezotransducer.

3. A valveless pump according to claim 1 wherein said means defining a connection of variable length comprises a member of variable length made of a magnetostrictive material.

4. A valveless pump according to claim 1, wherein said variable length means is regulated by a compensating means being responsive to temperature to control the variable length means so as to be independent of temperature.

5. A valveless pump according to claim 1, wherein said variable length means includes a variable length bar having a longitudinal axis parallel to an axis of a cylinder, each of said pistons being rigidly mounted to one of said fastening members.

6. A pump according to claim 1 including a check valve connected to said delivery port.

7. A pump according to claim 1 further comprising a temperature sensor connected to said pump for measuring the temperature around said pump and compensating circuit means connected to said temperature sensor member and connected to said variable length means for compensating temperature effects on said variable length means.

8. A pump according to claim 1 wherein said length varying means comprises a piezotransducer electric member and means connected to said member for applying a voltage to said piezotransducer, said pistons being moveable toward each other adjacent said inlet port, being separable at said inlet port to allow fluid into said pump and said pistons being moveable together in spaced relationship to said outlet and thereafter being moveable together at said outlet to discharge the substance which is drawn into the pump.

9. A method to provide a dosing of a substance to a respirator using a pump cylinder having spaced apart inlet and outlet ports arranged along its axis and having two pistons therein which are arranged in opposition so that their end faces may move toward and away from each other and which includes connecting the pistons so that they are moved axially toward and away from each other in a manner so as to bring the pistons together substantially at the inlet port and to effect the movement of one piston while the first is arranged adjacent the end port to bring in a dosage of material from the inlet port, to then move the pistons together toward the outlet port while they are in spaced relationship and to there after close the pistons toward each other at the outlet port to finish a pumping cycle and to provide a connection between the pistons by a variable length member to effect movement of the pistons in the desired relationship.

10. A method according to claim 9 wherein the variable length connection between the two pistons comprises a piezotransducer which is operated to vary the length of the connection between the first and second pistons.

* * * * *